United States Patent [19]

Tengler et al.

[11] Patent Number: 4,897,046

[45] Date of Patent: Jan. 30, 1990

[54] SHIELDED CONNECTOR SYSTEM FOR COAXIAL CABLES

[75] Inventors: John N. Tengler, Chico, Calif.; Alan L. Roath; John T. Venaleck, both of Madison, Ohio

[73] Assignee: Minnesota Mining and Manufacturing Company, Saint Paul, Minn.

[21] Appl. No.: 914,803

[22] Filed: Oct. 3, 1986

[51] Int. Cl.[4] ..... H01R 17/18

[52] U.S. Cl. ..... 439/579; 439/610; 439/452

[58] Field of Search ..... 439/92, 98, 99, 607–610, 439/578–585, 675, 736, 322, 449, 452, 604, 492, 494, 497, 499

[56] References Cited

U.S. PATENT DOCUMENTS

| | | | |
|---|---|---|---|
| 3,109,997 | 11/1963 | Giger et al. . | |
| 3,179,912 | 4/1965 | Huber et al. . | |
| 3,335,388 | 8/1967 | Karol . | |
| 3,408,610 | 10/1968 | Clarkson . | |
| 3,781,763 | 12/1973 | Feeser et al. . | |
| 3,825,874 | 7/1974 | Peverill . | |
| 3,848,164 | 11/1974 | Otte . | |
| 4,088,385 | 5/1978 | Adkins . | |
| 4,231,629 | 11/1980 | Kirby . | |
| 4,340,265 | 7/1982 | Ott et al. . | |
| 4,397,516 | 8/1983 | Koren et al. . | |
| 4,451,107 | 5/1984 | Dola et al. . | |
| 4,453,796 | 7/1984 | Monroe . | |
| 4,484,792 | 11/1984 | Tengler et al. | 439/736 |
| 4,519,665 | 5/1985 | Althouse et al. . | |
| 4,553,806 | 11/1985 | Forney, Jr. et al. . | |
| 4,556,275 | 12/1985 | Hamsher | 439/736 |
| 4,572,605 | 2/1986 | Hess | 439/736 |
| 4,586,776 | 5/1986 | Ollis et al. | 439/736 |
| 4,602,831 | 7/1986 | Lockard | 439/736 |
| 4,603,926 | 8/1986 | Nesbit et al. . | |

*Primary Examiner*—David Pirlot

*Attorney, Agent, or Firm*—Renner, Otto, Boisselle & Sklar

[57] ABSTRACT

A coaxial cable termination system, includes a coaxial cable terminator including a coaxial cable having signal and shield conductors and insulation separating the conductors, an electrical contact electrically connected to the signal conductor, the electrical contact having a contacting portion for electrically connecting with an external member inserted to engagement with respect thereto, a protective insulator for covering at least part of the contacting portion, and a strain relief body molded directly to at least part of the coaxial cable, electrical contact and protective insulator for holding the same in relatively fixed positions with respect to each other; and a housing for receiving therein the terminator to hold the same in position to make electrical connectioin with an external member inserted into the housing means to engage the electrical contact.

3 Claims, 2 Drawing Sheets

SHIELDED CONNECTOR SYSTEM FOR COAXIAL CABLES

TECHNICAL FIELD

The present invention relates generally, as is indicated, to connector systems for coaxial cables and, more particularly, to shielded connector systems and to terminators for use therein. Additionally, the invention relates to terminators for miniature coaxial cables and to systems for terminating miniature coaxial cables.

BACKGROUND

For high speed signal transmission purposes and possibly for other purposes it is often the case that coaxial cables are used. The advantages of coaxial cables are, of course, well known and include, for example, the ability to provide shielding functions to prevent escape of electromagnetic energy and/or undesirable input of electromagnetic energy with respect to signal conductors. Another example has to do with impedance characteristics that improve accuracy and/or efficiency, e.g. speed, of signal transmission.

An exemplary coaxial cable typically includes a signal conductor, a shield or ground conductor and appropriate insulation. Sometimes a drain wire is used, for example, to improve the integrity of the shield conductor. Ordinarily the signal conductor is located at the radial center of the coaxial cable and insulation separates the signal conductor from the radially outer and usually surrounding shield conductor. The shield conductor may be, for example, a hollow cylinder with a solid wall or a braided material. Various insulation materials are used to separate the signal and shield conductors, as is well known; and it usually is the case that further insulation is used on the outside of the shield conductor as well. Usually the signal conductor is used to conduct an electrical signal that has a particular purpose, information content, etc., and usually the shield conductor is connected to a source of reference electrical potential, such as ground potential relative to the level of the signals typically carried by the signal conductor. The foregoing signal carrying functions and connections, of course, are exemplary only, and it will be appreciated that the conductors of the coaxial cable may be used for other signal carrying/conducting purposes, too.

Various techniques have been used in the past to terminate a coaxial cable. The present invention provides improvements for terminating coaxial cable and for connecting the cable to other conductors while minimizing signal degradation and while substantially maintaining in the terminator electrical characteristics similar to those in the coaxial cable.

BRIEF SUMMARY OF THE INVENTION

Briefly, the fundamental components of the present invention include a coaxial cable termination system, comprising a coaxial cable terminator including a coaxial cable having signal and shield conductors and insulation separating said conductors, an electrical contact electrically connected to the signal conductor, the electrical contact having a contacting portion for electrically connecting with an external member inserted to engagement with respect thereto, a protective insulator means for covering at least part of the contracting portion, and a strain relief body molded directly to at least part of the coaxial cable, electrical contact and a protective insulator for holding the same in relatively fixed positions with respect to each other; and a housing for receiving therein the terminator to hold the same in position to make electrical connection with an external member inserted into the housing means to engage the electrical contact.

Another aspect of the invention relates to a coaxial cable terminator, comprising a coaxial cable having signal and shield conductors and insulation separating the conductors, an electrical contact electrically connected to the signal conductor, the electrical contact having a contacting portion for electrically connecting with an external member inserted to engagement with respect thereto, a protective insulator for covering at least part of the contacting portion, and a strain relief body molded directly to at least part of the coaxial cable, electrical contact and insulator for holding the same in relatively fixed positions with respect to each other.

As is described in detail below, the invention helps to maintain impedance characteristics of the cable through the interconnection device (terminator and housing) by the illustrated geometrical relationships, the bringing of the signal contacts and the ground (e.g. provided by the housing) to a near coterminal relation at the front end thereof, the use of the ground contacts and the sharing thereof and relative positioning thereof with respect to the signals carried by the terminators, and so on. These and other relationships and interactions may be used in various combinations consistent with the present invention.

These and other objects and aspects of the present invention will become more apparent as the following description proceeds.

To the accomplishment of the foregoing and related ends, the invention, then, comprises the features hereinafter described in the specification and particularly pointed out in the claims, the following description and the annexed drawings providing but one exemplary illustration of a preferred embodiment of the invention. However, it will be appreciated that the invention relates to equivalent parts and functions and is limited only to the extent of the scope of the claims.

DESCRIPTION OF THE PREFERRED EMBODIMENT

Figure 1:
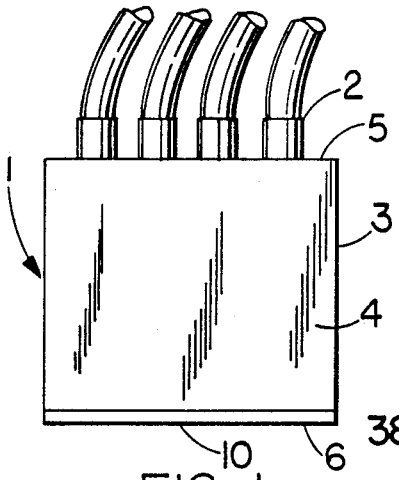
FIG. 1 is an elevation view of a coaxial cable termination system according to the present invention.
Figure 2:
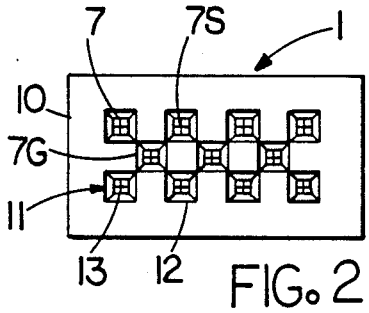
FIG. 2 is a front view of the termination system of FIG. 1.

Referring now, in detail to the drawings, wherein like reference numerals designate like parts in the several figures, and initially to FIGS. 1 and 2, a coaxial cable termination system in accordance with the present invention is generally designated 1. The termination system 1 includes one or more coaxial cable terminators 2 that are insertable into a housing 3. Each terminator 2 may, for example, be used to carry a signal, such as a high speed electrical signal. The housing 3 may be a zinc or an aluminum block 4 that is cast and has plural openings therethrough to receive respective terminators therein.

Figure 9:
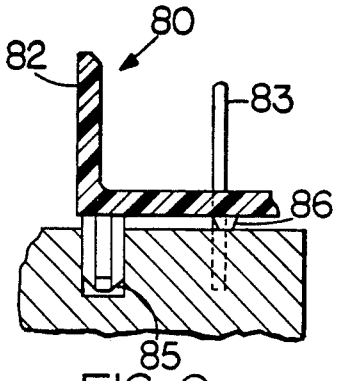
FIG. 9 is an enlarged fragmentary section view of the pinless shroud showing the retaining post thereof for retention in a printed circuit board and showing header pin contacts protruding therein for electrical connection with the electrical contacts of the termination system of the invention.

The housing block 4 provides structural support for the terminators where they connect with other external members, such as electrical pin contacts (shown in FIG. 9). Such support function, and an associative protective function, are important in the present invention in view of the possible substantial miniaturization of the coaxial cable and termination associated therewith to make up the coaxial cable terminator. The housing block also preferably is electrically conductive so that it provides a substantial shielding function as well as a direct engagement electrical connection grounding function along the entire length of the termination portion of the terminator where the insulation of the signal and shield conductors of the coaxial cable and where the electrical contact of the terminator are otherwise exposed, as will become more apparent from the following description.

As is seen in FIGS. 1 and 2, the housing block 4 has a back end 5 into which the terminators 2 are inserted and a front or leading end 6 into which external members, hereinafter referred to as pin contacts or the like, may be inserted for electrical connection with the signal conductor, for example, of respective terminators. It will be appreciated that the external members, though, may be other than pin contacts. Openings 7 (discussed further below) extend through the housing 3 to permit such insertion of the terminators 2 and pin contacts. The housing block 4 may be a rectangular cross section block of electrically conductive metal. Alternatively, although less desirably, the housing block 3 may be of plastic or other material that has an electrically conductive coating on the surface to provide the desired electrical connection and shielding functions.

Figure 3:
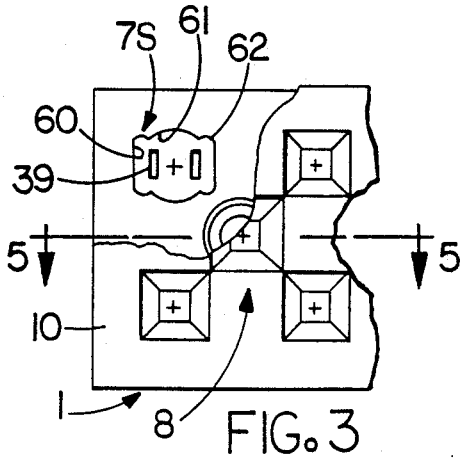
FIG. 3 is an enlarged fragmentary front view of the termination system partly broken away to show an opening in the housing and part of a signal contact.
Figure 5:
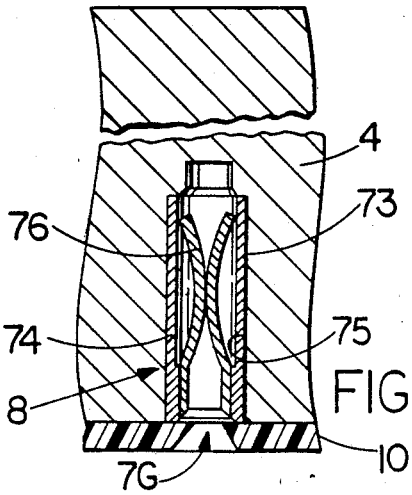
FIG. 5 is an enlarged fragmentary section view of the ground contact arrangement for the termination system looking generally in the direction of the arrows 5—5 of FIG. 3.

The housing 3 also includes one or more ground contact connections 8 (FIGS. 3 and 5). As is described in greater detail below, such ground contact connections 8 bring a ground connection of a printed circuit board or other device from which the mentioned pin contacts derive to close proximity with respective signal carrying coaxial cable terminators 2 without having to rely on the electrical conducting properties of the housing block 4 over more than a relatively minimal extent. Such use of ground connections rather proximate the signal connections provided by the terminators 2 helps to maintain the integrity (e.g. wave shape) and transmission speed of the transmitted electrical signal(s) while also helping to maintain the desired characteristic impedance matched to that of the coaxial cable 9. Accordingly, desirably there is a ground contact connection 8 in close proximity to each signal carrying terminator 2; and this is possible in the present invention even with plural terminators 2 by using, for example, a shared arrangement of ground contact connections 8, say as is shown in FIGS. 1-3.

Thus, a preferred pattern for the termination system 1, according to the invention, when plural signals and terminators 2 carrying them are used, is the shared configuration illustrated in FIG. 2. Such arrangement places a ground contact connection for effective use with four signal contacts. The ground contact openings in the termination system 1 are designated 7G, and the signal carrying/terminator openings are designated and referred to interchangeably 7 and 7S and, depending on context, the openings 7S, 7G may be collectively referred to as openings 7. The system 1 illustrated in FIGS. 1 and 2 has eight signal connection positions represented by the openings 7S and also has four ground connection positions. If desired, the termination system 1 may be reduced in size to have as few as two positions, one for ground and one for signal; or the system 1 may be expanded in size, say to provide for thirty, sixty or more or fewer signal positions and corresponding ground positions, e.g. by replicating the pattern arrangement shown in FIGS. 1 and 2.

To help prevent pin contacts and/or other devices from engaging and short circuiting with the housing block 4, a front insulator 10 is provided at the front end 6 of the housing block 4. The front insulator may be an electrically non-conductive plate having plural openings 11 therein positioned to align with respective openings 7 in the housing block. Moreover, such openings 11 preferably have a tapered or sloping front wall 12 or lead in to guide a pin contact into and through the passage 13 of the respective opening 11 into the opening 7 of the housing block 4. Furthermore, such sloping lead in 12 is of a size to guide a pin contact into the opening 7 without touching an interior wall of such opening 7, as is seen more clearly in FIG. 4, for example.

Since the termination system 1 has a regular configuration, e.g. the housing 3 has a rectangular footprint and generally straight side walls, preferably multiple systems 1 may be placed in close proximity to each other to increase the number of connections made between coaxial cables and pin contacts, say arranged in a pin field on a printed circuit board, in a relatively minimum space while continuing the desired ground, shielding and impedance matching characteristics. The system 1 may have another configuration that also provides such functions to various respective degrees of density of signal carrying coaxial cable terminators 2. Means (not shown) may be provided for separately mounting and/or securing the housing 3 to a printed circuit board or to another device to hold the termination system 1 in appropriate location for use.

Figure 4:
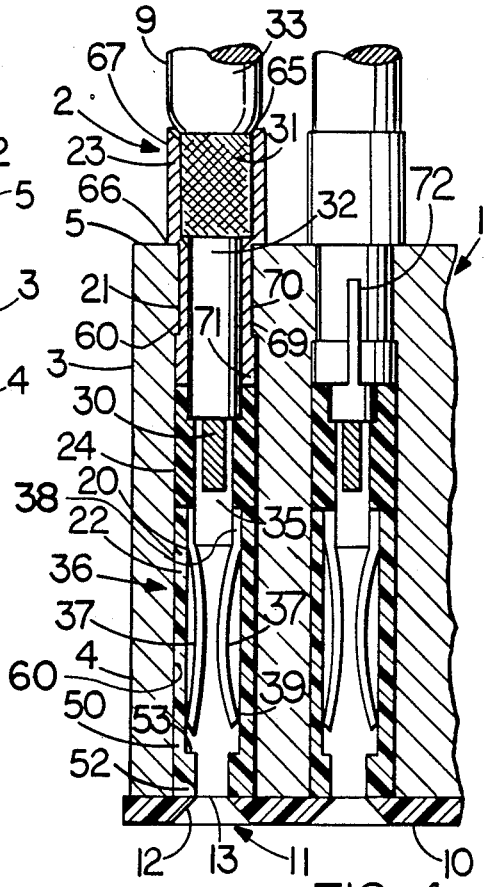
FIG. 4 is an enlarged fragmentary section view of the signal contacts and coaxial cable terminators of the termination system looking generally in the direction of the arrows 4—4 of FIG. 3.

Turning, now, to FIGS. 3 and 4 details of the terminator 2 and the cooperative relation thereof with respect to the housing 3 are shown. The terminator 2 includes the coaxial cable 9, a first electrical contact (the signal contact) 20, a second electrical contact (the shield or ground contact) 21, a protective electrically non-conductive sheath 22 at the leading end of the terminator, an electrically conductive shield terminator 23 at the back end of the terminator and of which the ground contact is a part, and a strain relief body 24 directly molded to at least part of each of the foregoing to form a substantially secure structure therewith.

The coaxial cable 9 includes a signal conductor 30, a ground or shield conductor 31, insulation 32 separating such conductors, and an outer insulation jacket 33. The invention is particularly useful with miniature coaxial cables, and, accordingly, such cable 9 preferably is a miniature one and the terminator 2 is of a cross sectional size enabling use to connect with respective pin contacts in a pin field on, for example, less than 0.100 centers spacing arrangement. Such cables 9 themselves are commercially available.

Toward the leading end of the terminator 2 is the signal contact 20. Such signal contact has a flat connecting portion (or other shape portion) 35 for electrical attachment to the exposed end of the signal conductor 30 of the cable 9. Such electrical attachment may be by soldering, welding or the like. The signal contact 20 also includes a contacting portion 36 intended to make an electrical connection with a pin contact or other external member that is inserted to engage the same. As is described herein, the pin contact is inserted to engage the signal contact 20; however, it will be appreciated that the insertion movement may be of the signal contact with respect to the pin contact. What is required is relative movement of the signal contact and pin contact to effect electrical connection thereof.

Looking at FIG. 4, the contacting portion 36 of the signal contact 20 is formed by a pair of bowed arms 37 that are bent or otherwise formed relative to the flat connecting portion 35 so that the width dimension thereof is generally perpendicularly oriented relative to the width dimension of the flat connecting portion. The bowed configuration of the arms 37 is such that a relatively narrow contacting area is located therebetween for interference fit with a pin contact inserted to engage the same. At the back end of the arms 37 they are attached to the flat connecting portion by relatively straight supports 38 of the contact 20, and the leading end 39 of the bowed arms 37 are supported by the protective sheath 22. The bowed contact configuration provides good compliance characteristics for the signal contact 20. The paired arms 37 also may allow for a degree of balancing of forces as and after a pin contact is inserted therebetween to minimize the maximum deformation of each arm 37. Further, in view of the miniature size of the signal contact, e.g. having a length on the order of less than one half inch and a thickness of material less than 0.010 inch, the dual support of each bowed arm 37, i.e. both at the back end supports 38 and at the leading ends 39, desired compliance, miniaturization and operational characteristics can be achieved without damaging the contact 20 as pin contacts are inserted to engage the same.

Figure 6:
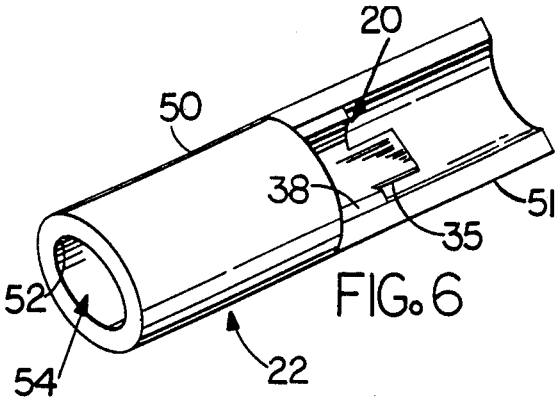
FIG. 6 is an enlarged fragmentary view of the protective insulator and part of the electrical contact of the terminator according to the invention.

As is seen in FIGS. 3 and 6, the protective sheath 22 as in the form of a hollow tubular member 50 with one or more tail portions 51. The hollow tube 50 has an outside dimension to fit relatively snugly (although a smooth sliding fit of various degrees of tightness or looseness may be achieved as a function of relative dimensions) in a signal opening 7S of the housing block 4. At the leading end of the tube 50 is a relatively thick wall 52 the purpose of which is to provide strength and, more importantly, to provide a protective step 53 beneath which the leading end 39 of the bow contact arms 37 are protected from directly engaging an inserted pin contact thereby preventing the possibility of damage to the arms 37, particularly by the insertion of a misaligned pin contact into the opening 7S. The thickness of such wall 52 is approximately the same as the cross sectional dimension of the passage 13 through opening 11 of the front insulator 10 so that the tapered lead in 12 of the opening 11 provides a smooth direct entry into the interior 54 of the protective sheath 22 for guiding a pin contact to engagement with the contacting portion 36 arms 37 of the signal contact 20.

The protective tubular sheath 22 provides a function of electrically insulating the signal contact 20 from the interior wall 60 of the housing 3 opening 7S. Preferably at least part of both the supports 38 and leading ends 39 of the contacting portions 36 or arms 37 of the signal contact 20 engage the surface of the interior wall of the sheath support to provide dual support for the arms 37, i.e. at both the forward and rearward ends thereof, to achieve the above-mentioned compliance, strength and repetitive operational characteristics.

Preferably, too, the impedance characteristics of the protective sheath 22, the amount of material used in the same, the configuration of the signal contact 20, and the spacing of the signal contact and, particularly the contacting portion 36 thereof, relative to the interior wall 60 of the housing opening 7S are so selected to tend to maintain along the length of the signal contact 20 effectively the same impedance characteristics as the characteristic impedance, say 50 ohms, of the coaxial cable 9. For this purpose, the sizes of the parts of the signal contact 20 and the size, thickness and shape of the protective sheath 22 are, accordingly, selected to have a relationship generally as is depicted in the drawings. Moreover, provision for air space also is made to lump the impedance of such air space with that of the various solid materials of the terminator.

Additionally, as is seen in FIG. 3, the cross sectional shape of the opening 7S is a multi-curved configuration with several different radii of curvature straight wall portions. Indeed, such shape is generally oval or elliptical. The narrow axis, e.g. vertical as viewed in FIG. 3, provides spacing for a pin contact relative to the wall area 61 of the opening 7S a distance that tends to maintain the mentioned impedance matching with respect to the characteristic impedance of the cable 9. Moreover, the larger axis, e.g. horizontal as viewed in FIG. 3, provides spacing for such pin contact and the arms 37 of the signal contact 20 relative to the wall area 62 of the opening 7S for the same purpose. The thickness of the wall of the protective sheath 22 preferably is minimized, while still maintaining adequate thickness for desired strength, to provide a relatively maximum air space between the electrically conductive portions of the signal contact and pin contact, on the one hand, and the respective wall areas of the opening 7S of the housing 3.

The tail 51 of the protective sheath 22 extends relatively rearwardly to provide a connection thereof with the molded strain relief 24. Such strain relief 24 may tend to knit with such tail 51 to form a secure integral structure therewith. The tail 51 is seen most clearly in FIG. 6 as a single tail that represents a semicircular cross sectional portion of the forward hollow tubular part 50 of the sheath 22. Thus, the sheath 22 may be formed of plastic or like material that is electrically non-conductive and that can be formed by plastic injection molding techniques.

The shield terminator 23 preferably is a hollow metal tube, e.g. of brass, that can slide over the cable 9 to engage the shield conductor 31 of the cable. Such shield conductor 31 may be a braided shield, as is well known, or may be another type of shield. The shield terminator 23 and the shield conductor 31 may be soldered, as at 65, to form a good electrical and mechanical connection thereof. Moreover, the two preferably are positioned in relatively tight fitting relation to each other to form a force fit connection thereof, e.g. by a distorting force applied to the shield termination as it is inserted into the opening 7S of the housing 3.

At the leading or forward end of the shield terminator 23 where it forms the ground contact 21 for the terminator 2, it preferably is engaged with and molded to the strain relief 24, as the latter is molded in place after the shield terminator is installed on the cable 9.

Further, the shield terminator 23 has a step 66 between the portion 67 thereof that engages the cable shield conductor 31 and remains outside the housing 3 and the ground contact portion 21 that extends into the opening 7S of the housing 3. Such step is provided to limit the maximum insertion penetration of the terminator 2 into the opening 7S so that the leading end of the protective sheath 22 will not be damaged by forcing the same against the front insulator 10 and also will not damage the latter. Moreover, such step 67 also provides electrical connection between the back end 5 of the housing 3 and the shield terminator 23.

At the back end of the opening 7S in the housing 3 is a reduced cross section detent portion 69; and at an axially central portion of the shield terminator 23 is a relief or reduced thickness area 70 of the tubular body of the terminator 23. Such detent portion 69 and relief 70 are cooperatively interrelated to provide a locking function to interfere with each other thereby to tend to retain the terminator 2 in the opening 7S of the housing 3.

As is seen in FIG. 4, the thicker forward end 71 of the shield terminator 23 can provide a force fitting function with respect to the drain wire 72 of the coaxial cable 9 tending to force such drain wire into engagement with the wall area 61 of the opening 7S. Additionally, or alternatively, such drain wire 72 may be soldered or welded to the outside of such shield terminator 23.

To manufacture the terminator 2, the cable 9 is appropriately stripped, e.g. as is seen in FIG. 4, to expose the various portions of the braid or shield conductor 31, of the insulation 32, and of the signal conductor 30. The shield terminator 23, such as the described brass ferrule or the like, is slid to place and is soldered to the shield conductor 31. Thereafter, the signal contact 20 and signal conductor 30 are soldered or welded together. The protective sheath 22 is slid to place placing at least part of the contacting portion 36 of the signal contact 20 therein and placing the tail 51 thereof in direct engagement with the leading edge of the shield terminator 23. The strain relief body 24 then is directly molded in place in such a way as to form a secure and substantially integral structure with the cable 9, signal contact 20, protective sheath 22, and shield terminator 23, as is illustrated in FIG. 4, for example. The material of which the strain relief 24 is made is that which preferably can be injection molded, e.g. plastic, and preferably has impedance characteristics that help to assure substantial matching of the impedance characteristics of the cable 9. An example of such molding material may be a polyolefin.

Preferably the outside configuration of that part of the terminator 2 that is inserted into the opening 7S is generally cylindrical. Moreover, the radius of curvature of such cylindrical terminator is about the same as that of the wall area portions 61 of the opening 7S. Therefore, such wall areas 61 cooperate with the outside surface of the terminator 2 to hold the latter relatively securely and without movement within the opening 7S.

Referring to FIGS. 3 and 5, the ground contact connection 8 includes a ground contact 73, which preferably is a press fit conventional contact that is inserted into the ground opening 7G in the housing block 4. Such contact 73 preferably has a portion 74 that makes good electrical connection with the walls 75 of the opening 7G and also has compliant contacting portions 76 for electrically connecting with a pin contact or the like inserted to engagement with respect thereto. The opening 7G may be stepped, as is shown to accommodate the ground contact 73 and also to provide for full insertion of a pin contact into the same. Preferably the opening 11 of the front insulator 10 is aligned with the ground opening 7G and ground contact 73 has the same useful tapered lead in 12 and passage 13 configuration as with the openings 11 aligned with signal openings 7S to guide pin contacts into the ground opening 7G without damaging either the ground contact 73 or the inserted pin contact.

As is seen in FIG. 3, moreover, the cross sectional shape of the ground opening 7G preferably is circular to accommodate the ground contact 73.

The pattern of openings 7S, 7G and of contacts in the housing 3 and overall system 1 is such that a number, e.g. four, of signals can share a common ground; also, relatively maximum spacing of signals is provided while relatively close spacing of the signals to the respective ground is provided.

Figure 7:
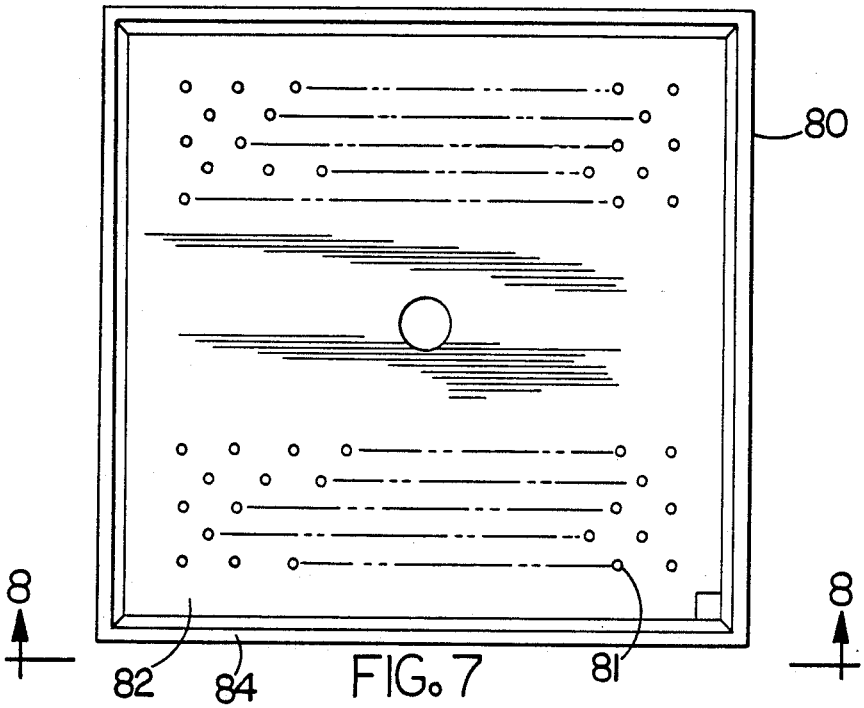
FIG. 7 is an elevation view of a pinless shroud for use with the termination system of the invention.
Figure 8:
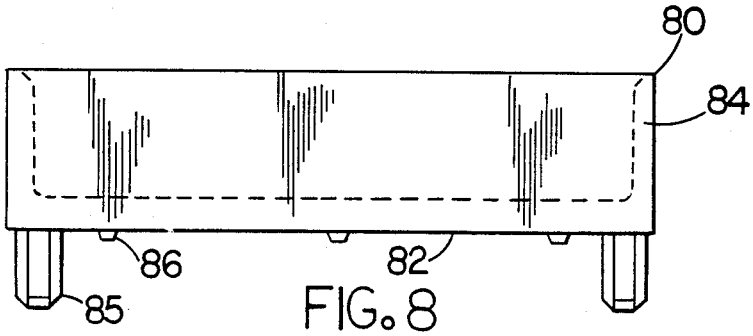
FIG. 8 is a top plan view of the pinless shroud looking generally in the direction of the arrows 8—8 of FIG. 7.

Briefly referring to FIGS. 7, 8 and 9, a pinless shroud 80 is shown. The shroud 80 preferably is formed of electrically non-conductive material that is made by plastic injection molding. The shroud 80 has plural openings 81 (FIG. 7) in the bottom wall 82 thereof to pass therethrough respective pin contacts 83 (FIG. 9) constituting a pin field that is accessible for connection to the termination system 1 of the invention. The pin contacts 83 are omitted from FIG. 7 for simplifying the drawing; the openings 81 through which such pin contacts 83 extend are shown in FIG. 8. The shroud provides support and alignment features for the system 1 and the pin contacts 83. To those ends, the shroud has side walls 84 to guide the housings 3 to proper location therein; a plurality of such housings 3 of small size or one of larger size may be installed within the shroud on respective pin contacts 83.

At the bottom of the shroud 80 are a plurality of retaining posts 85 that may fit into openings on the surface of a printed circuit board to retain the shroud thereon. The shroud may be used, too, to help assure separation of the front end of the system 1 from the surface of the printed circuit board to avoid interfering with circuits printed thereon; additionally, the shroud 80 may have stand offs 86 to help keep the wall 82 thereof also off the surface of the printed circuit board.

INDUSTRIAL APPLICATION

In view of the foregoing it will be appreciated that the present invention provides for electrical interconnections, especially of coaxial cables, and more especially of miniature coaxial cables.

We claim:

1. A coaxial cable termination system, comprising a coaxial cable terminator including a coaxial cable having signal and shield contact electrically connected to said signal conductors, an electrical contact electrically connected to said signal conductor, said electrical contact having a contacting portion for electrically connecting with an external member inserted to engagement with said contacting portion, a protective insulator means for covering at least part of said contacting portion, and a strain relief body molded directly to at least part of said coaxial cable, electrical contact and protective insulator means for holding the same in relatively fixed positions with respect to each other; and housing means for receiving therein said terminator to hold the same in position to make electrical connection with an external member inserted into said housing means to engage said electrical contact, and said protective insulator means comprising a hollow cylindrical tube portion and a split back end for cooperating with said strain relief to facilitate securing said insulator means and said strain relief body with respect to each other.

2. A coaxial cable termination system, comprising at least four coaxial cable terminators each including a coaxial cable having signal and shield conductors and insulation separating said conductors, a signal contact electrically connected to said signal conductor, and a shield contact electrically connected to said shield conductor; an electrically conductive housing means for positioning said terminators with respect to one another and for functioning as a commoning element for said shield contacts of said terminators; and at least one ground contact means for electrically connecting said housing means to another device; said housing means including at least four terminator openings for receiving and holding respective ones of said four terminators and at least one ground contact opening for receiving said one ground contact means, said four terminator openings being located at respective corners of a square with each pair of relatively adjacent ones of said four terminator openings defining a side of said square, said ground contact opening being located at the center of said square, and said ground contact opening being closer to said four terminator openings than any other terminator opening in said housing means.

3. The system of claim 2, wherein at least one pair of said four terminator openings defines with another adjacent pair of terminator openings a second square adjacent said first square, and said housing means includes a second ground contact opening at the center of said second square.

* * * * *

UNITED STATES PATENT AND TRADEMARK OFFICE

CERTIFICATE OF CORRECTION

PATENT NO. : 4,897,046

DATED : January 30, 1990

INVENTOR(S) : John N. Tengler

It is certified that error appears in the above-identified patent and that said Letters Patent is hereby corrected as shown below:

Column 9, lines 1 and 2, replace "contact electrically connected to said signal conductors" with --conductors and insulation separating said conductors--.

Column 9, line 18, after "relief" insert --body--.

Signed and Sealed this

Twenty-second Day of September, 1992

*Attest:*

DOUGLAS B. COMER

*Attesting Officer*

*Acting Commissioner of Patents and Trademarks*